US010273658B2

(12) United States Patent
Hijikata et al.

(10) Patent No.: US 10,273,658 B2
(45) Date of Patent: Apr. 30, 2019

(54) CONSTRUCTION MACHINE

(71) Applicant: HITACHI CONSTRUCTION MACHINERY CO., LTD., Tokyo (JP)

(72) Inventors: Seiji Hijikata, Tsukuba (JP); Kouji Ishikawa, Kasumigaura (JP); Yasutaka Tsuruga, Ryugasaki (JP); Masatoshi Hoshino, Tsuchiura (JP); Kiwamu Takahashi, Moriyama (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 119 days.

(21) Appl. No.: 15/506,894

(22) PCT Filed: Mar. 16, 2015

(86) PCT No.: PCT/JP2015/057629
§ 371 (c)(1),
(2) Date: Feb. 27, 2017

(87) PCT Pub. No.: WO2016/147283
PCT Pub. Date: Sep. 22, 2016

(65) Prior Publication Data

US 2017/0284064 A1 Oct. 5, 2017

(51) Int. Cl.
*F16D 31/02* (2006.01)
*E02F 9/22* (2006.01)
(Continued)

(52) U.S. Cl.
CPC ..... *E02F 9/2217* (2013.01); *E02F 9/2228* (2013.01); *E02F 9/2267* (2013.01);
(Continued)

(58) Field of Classification Search
CPC .. F15B 1/024; F15B 13/0422; F15B 13/0424; F15B 2013/0428; F15B 13/0433;
(Continued)

(56) References Cited

FOREIGN PATENT DOCUMENTS

| | | | |
|---|---|---|---|
| JP | 2009-150413 | A | 7/2009 |
| JP | 2009-250361 | A | 10/2009 |
| JP | 2014-227949 | A | 12/2014 |

OTHER PUBLICATIONS

International Preliminary Report on Patentability received in corresponding International Application No. PCT/JP2015/057629 dated Sep. 28, 2017.

(Continued)

*Primary Examiner* — Michael Leslie
(74) *Attorney, Agent, or Firm* — Mattingly & Malur, PC

(57) ABSTRACT

The construction machine includes: a control valve that switchingly supplies hydraulic fluid from a hydraulic pump to a hydraulic actuator; a control valve drive device that supplies pilot secondary hydraulic fluid to the control valve in accordance with an operation of an operation lever device; a pilot hydraulic pump that supplies pilot primary hydraulic fluid to the control valve drive device; a pressure accumulation device that recovers return hydraulic fluid returned from the hydraulic actuator. The construction machine further includes: a check valve provided in a line between the pilot hydraulic pump and the control valve drive device; a pressure reducing valve that supplied the hydraulic fluid accumulated in the pressure accumulation device; a flow rate reduction device; and a controller that controls the flow rate reduction device in accordance with the pressure in the line between the check valve and the control valve drive device.

3 Claims, 5 Drawing Sheets

(51) Int. Cl.

| | |
|---|---|
| ***F15B 1/02*** | (2006.01) |
| ***F15B 13/043*** | (2006.01) |
| ***F15B 21/14*** | (2006.01) |
| *F15B 13/042* | (2006.01) |
| *E02F 9/20* | (2006.01) |

(52) U.S. Cl.
CPC ..... *E02F 9/2285* (2013.01); *E02F 9/2296* (2013.01); *F15B 1/024* (2013.01); *F15B 13/0433* (2013.01); *F15B 21/14* (2013.01); *E02F 9/2012* (2013.01); *E02F 9/2225* (2013.01); *F15B 2013/0428* (2013.01); *F15B 2211/20546* (2013.01); *F15B 2211/212* (2013.01); *F15B 2211/50536* (2013.01); *F15B 2211/50554* (2013.01); *F15B 2211/6316* (2013.01); *F15B 2211/6355* (2013.01); *F15B 2211/67* (2013.01); *F15B 2211/88* (2013.01)

(58) Field of Classification Search
CPC ..... F15B 21/14; E02F 9/2217; E02F 9/2267; E02F 9/2285
USPC ..... 60/414
See application file for complete search history.

(56) References Cited

OTHER PUBLICATIONS

International Search Report of PCT/JP2015/057629 dated Jun. 2, 2015.

CONSTRUCTION MACHINE

TECHNICAL FIELD

The present invention relates to a construction machine, and particularly relates to a construction machine, such as a hydraulic excavator, which includes a hydraulic actuator and is provided with a device for recovering the energy of hydraulic fluid coming from the hydraulic actuator.

BACKGROUND ART

For the purpose of providing a regeneration circuit for a hydraulic cylinder operation pressure with which energy savings can be realized, there has been disclosed a regeneration circuit for a hydraulic cylinder operation pressure in which an accumulator is provided for accumulating either one of a holding pressure and a return pressure discharged from a hydraulic cylinder at the time of an operation of the hydraulic cylinder, and the hydraulic pressure accumulated in the accumulator is used as a pilot pressure in a pilot control system (refer to, for example, Patent Document 1).

PRIOR ART DOCUMENT

Patent Document

Patent Document 1: JP-2009-250361-A

SUMMARY OF THE INVENTION

Problems to be Solved by the Invention

In general, in a hydraulic excavator as a construction machine, a pilot system is uninterruptedly supplied with hydraulic fluid from a pilot pump. For this reason, the pilot pump consumes energy even when the hydraulic excavator is not in operation. Where hydraulic fluid is accumulated in an accumulator and a motor is stopped when the operation thereof is not needed, as described in the above-mentioned Patent Document 1, therefore, it is thereby possible to reduce useless energy loss and to achieve energy savings.

Meanwhile, in the regeneration circuit for a hydraulic cylinder operation pressure described in Patent Document 1, a pilot valve for generating operation hydraulic fluid at a secondary pressure according to the operation amount of an operation lever is supplied with primary hydraulic fluid from the pilot pump or the accumulator, and, in this case, a pressure reducing valve is provided in a system immediately upstream of the pilot valve. Therefore, the primary hydraulic fluid is supplied to the pilot valve, always through the pressure reducing valve. On the other hand, the pilot valve undergoes a change according to the operation amount of the operation lever, and, therefore, variations in the pressure in the pilot system (the primary hydraulic fluid and the second hydraulic fluid) may become large and steep. In such a case, if the primary hydraulic fluid is supplied to the pilot valve through the pressure reducing valve, a delay in response of the pressure reducing valve may lead to worsening of the response properties of the hydraulic actuator.

The present invention has been made on the basis of the foregoing. Accordingly, it is an object of the present invention to provide a construction machine having a configuration in which return hydraulic fluid from a hydraulic actuator is regenerated for a pilot system, energy outputted from a pilot pump can be utilized effectively, and response properties of the hydraulic actuator can be secured.

Means for Solving the Problems

To achieve the above object, according to a first-named invention, there is provided a construction machine including: a hydraulic actuator; a hydraulic pump that supplies hydraulic fluid to the hydraulic actuator; a control valve that switchingly supplies the hydraulic fluid from the hydraulic pump to the hydraulic actuator; an operation lever device that switchingly operates the control valve; a control valve drive device that supplies pilot secondary hydraulic fluid to the control valve in accordance with an operation of the operation lever device; a pilot hydraulic pump that supplies pilot primary hydraulic fluid to the control valve drive device; and a pressure accumulation device that recovers return hydraulic fluid returned from the hydraulic actuator, wherein the construction machine further includes: a check valve provided in a line between the pilot hydraulic pump and the control valve drive device; a pressure reducing valve that supplies the hydraulic fluid accumulated in the pressure accumulation device to a line between the check valve and the control valve drive device; a flow rate reduction device capable of reducing flow rate of the hydraulic fluid delivered by the pilot hydraulic pump; a pressure detection device capable of detecting pressure in the line between the check valve and the control valve drive device; and a controller that controls the flow rate reduction device in accordance with the pressure detected by the pressure detection device.

Effect of the Invention

According to the present invention, the output power of the pilot pump can be reduced by the return hydraulic fluid from the hydraulic actuator. In addition, even when the pressure in the accumulator is lowered and the pilot system is supplied with the hydraulic fluid from the pilot pump, energy can be utilized effectively and response properties of the hydraulic actuator can be secured.

MODE FOR CARRYING OUT THE INVENTION

Figure 1:
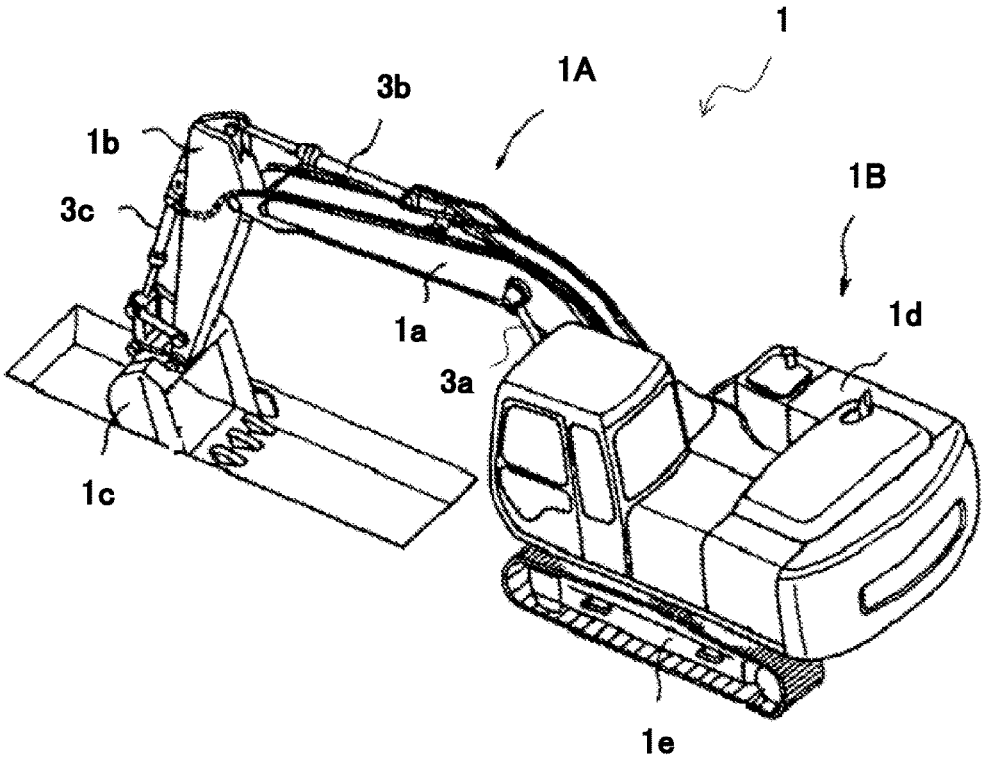
FIG. 1 is a perspective view showing a hydraulic excavator provided with one embodiment of a construction machine of the present invention.

An embodiment of a construction machine of the present invention will be described below, referring to the drawings.

Figure 2:
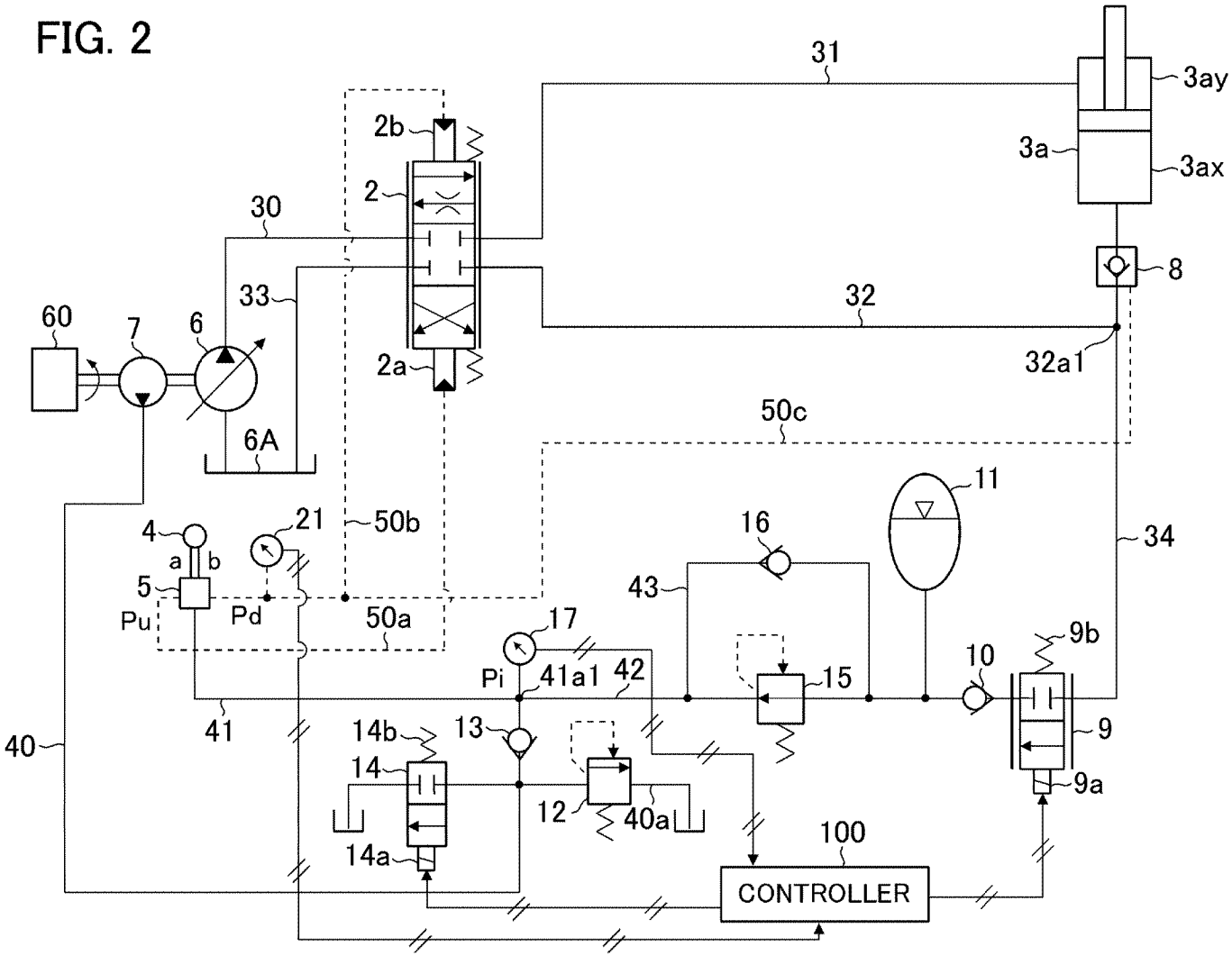
FIG. 2 is a schematic drawing showing an example of a control system constituting one embodiment of the construction machine of the present invention.

FIG. 1 is a perspective view showing a hydraulic excavator provided with one embodiment of the construction machine of the present invention, and FIG. 2 is a schematic drawing showing an example of a control system constituting one embodiment of the construction machine of the present invention.

In FIG. 1, a hydraulic excavator 1 includes an articulated type work implement 1A having a boom 1*a*, an arm 1*b* and a bucket 1*c*, and a vehicle body 1B having an upper swing structure 1*d* and a lower track structure 1*e*. The boom 1*a* is turnably supported on the upper swing structure 1*d*, and is driven by a boom cylinder (hydraulic cylinder) 3*a*. The upper swing structure 1*d* is swingably provided on the lower track structure 1*e*.

The arm 1*b* is turnably supported on the boom 1*a*, and is driven by an arm cylinder (hydraulic cylinder) 3*b*. The bucket 1*c* is turnably supported on the arm 1*b*, and is driven by a bucket cylinder (hydraulic cylinder) 3*c*. Driving of the boom cylinder 3*a*, the arm cylinder 3*b*, and the bucket cylinder 3*c* is controlled by an operation device 4 (see FIG. 2) that is disposed in an operation room (cabin) of the upper swing structure 1*d* and that outputs hydraulic signals.

In the embodiment shown in FIG. 2, only a control system concerning the boom cylinder 3*a* that operates the boom 1*a* is depicted. This control system includes a control valve 2, the operation device 4, a pilot check valve 8, a regeneration control valve 9 which is a solenoid selector valve, a pressure reducing valve 12, and an unloading valve 14 which is a solenoid selector valve as a flow rate reduction device.

As a hydraulic fluid source device, there are provided a hydraulic pump 6, a pilot hydraulic pump 7 that supplies pilot hydraulic fluid, a tank 6A, and an accumulator 11 as a pressure accumulation device that accumulates hydraulic fluid. The hydraulic pump 6 and the pilot hydraulic pump 7 are driven by an engine 60 connected thereto through a drive shaft.

In a line 30 for supplying hydraulic fluid from the hydraulic pump 6 to the boom cylinder 3*a*, there is provided the 4-port 3-position type control valve 2 that controls the direction and flow rate of the hydraulic fluid in the line. The control valve 2 has a configuration in which the position of a spool thereof is switched over by the supply of pilot hydraulic fluid to pilot pressure receiving sections 2*a* and 2*b*, whereby the hydraulic fluid from the hydraulic pump 6 is supplied to the boom cylinder 3*a*, to drive the boom 1*a*.

An inlet port of the control valve 2 to be supplied with the hydraulic fluid from the hydraulic pump 6 is connected to the hydraulic pump 6 through the line 30. An outlet port of the control valve 2 is connected to the tank 6A through a return line 33.

One end side of a rod-side hydraulic chamber line 31 is connected to one of connection ports of the control valve 2, and the other end side of the rod-side hydraulic chamber line 31 is connected to a rod-side hydraulic chamber 3*ay* of the boom cylinder 3*a*. In addition, one end side of a bottom-side hydraulic chamber line 32 is connected to the other of the connection ports of the control valve 2, and the other end side of the bottom-side hydraulic chamber line 32 is connected to a bottom-side hydraulic chamber 3*ax* of the boom cylinder 3*a*.

The bottom-side hydraulic chamber line 32 is provided with a recovery branching section 32*a*1 and the pilot check valve 8, in this order from the control valve 2 side. A recovery line 34 is connected to the recovery branching section 32*a*1.

The position of the spool of the control valve 2 is switchingly operated by an operation of an operation lever or the like of the operation device 4. The operation device 4 is provided with a pilot valve 5 as a control valve drive device. The pilot valve 5 generates pilot secondary hydraulic fluid at a pilot pressure Pu according to an operation amount of a tilting operation in a-direction in the figure (boom raising direction operation) of the operation lever or the like, from pilot primary hydraulic fluid supplied from the pilot hydraulic pump 7 through a pilot primary-side line 41 which will be described later. This pilot secondary hydraulic fluid is supplied to the pilot pressure receiving section 2*a* of the control valve 2 through a pilot secondary-side line 50*a*, and the control valve 2 is switched/controlled in accordance with the pilot pressure Pu.

Similarly, the pilot valve 5 as the control valve drive device generates pilot secondary hydraulic fluid at a pilot pressure Pd according to an operation amount of a tilting operation in b-direction in the figure (boom lowering direction operation) of the operation lever or the like. This pilot secondary hydraulic fluid is supplied to the pilot pressure receiving section 2*b* of the control valve 2 through a pilot secondary-side line 50*b*, and the control valve 2 is switched/controlled in accordance with the pilot pressure Pd.

Therefore, the spool of the control valve 2 is moved according to the pilot pressures Pu and Pd inputted to these two pilot pressure receiving sections 2*a* and 2*b*, to thereby switch the direction and flow rate of the hydraulic fluid supplied from the hydraulic pump 6 to the boom cylinder 3*a*.

The pilot secondary hydraulic fluid at the pilot pressure Pd is supplied also to the pilot check valve 8 through a pilot secondary-side line 50*c*. The pilot check valve 8 is actuated to open by the pressurization of the pilot pressure Pd. By this, the hydraulic fluid in the bottom-side hydraulic chamber 3*ax* of the boom cylinder 3*a* is led to the bottom-side hydraulic chamber line 32. The pilot check valve 8 is for preventing unprepared flowing of hydraulic fluid from the boom cylinder 3*a* into the bottom-side hydraulic chamber line 32 (boom falling). The pilot check valve 8 is normally interrupting a circuit, and is made to open the circuit by the pressurization of the pilot hydraulic fluid.

A pressure sensor 21 (operation amount detection means) is attached to the pilot secondary-side line 50*b*. This pressure sensor 21 detects the lowering-side pilot pressure Pd of the pilot valve 5 of the operation device 4 and functions as signal conversion means for converting the detected pressure into an electrical signal corresponding to the detected pressure, and it is configured to be able to output the converted electrical signal to a controller 100.

A hydraulic fluid energy recovery device will be described below. As shown in FIG. 2, the hydraulic fluid energy recovery device includes the recovery line 34, the regeneration control valve 9, a first check valve 10, the accumulator 11 as a pressure accumulation device, and the controller 100.

The recovery line 34 is provided with: the regeneration control valve 9 which is a solenoid selector valve; and the first check valve 10 and the accumulator 11 which are disposed on the downstream side of the regeneration control valve 9. The first check valve 10, provided between the regeneration control valve 9 and the accumulator 11, permits hydraulic fluid to only flow from the regeneration control valve 9 toward the accumulator 11 side, and inhibits the hydraulic fluid from flowing from the accumulator 11 side toward the regeneration control valve 9 side. When return hydraulic fluid at the time of boom lowering is led into the recovery line 34 and the regeneration control valve 9 is actuated to open, the return hydraulic fluid passes through the first check valve 10 and is accumulated in the accumulator 11.

The regeneration control valve 9 has a spring 9*b* on one end side thereof, and an operation section 9*a* on the other end side thereof. According to the presence or absence of a command signal outputted from the controller 100 to the operation section 9*a*, spool position of the regeneration control valve 9 is switched over, so as to control communication/interruption in regard of the return hydraulic fluid flowing from the bottom-side hydraulic chamber 3*ax* of the boom cylinder 3*a* to the accumulator 11.

Now, the configuration of the pilot hydraulic pump 7 and the pilot primary hydraulic fluid system will be described below. A pilot line 40 connected to a delivery port of the pilot hydraulic pump 7 is provided with: a relief valve 12 for limiting the pressure of hydraulic fluid in the pilot line 40; a second check valve 13; and an unloading valve 14 which is a solenoid selector valve as a flow rate reduction device. The pilot primary-side line 41 connected to the pilot valve 5 at one end side thereof is connected to the downstream side of the second check valve 13.

The relief valve 12 is for relieving the hydraulic fluid in the pilot line 40 to the tank 6A through a return circuit 40*a* when the pressure in the hydraulic line rises to or above a set pressure. The second check valve 13, provided between the pilot line 40 and the pilot primary-side line 41, permits hydraulic fluid to only flow from the pilot line 40 toward the pilot primary-side line 41 side, and inhibits the hydraulic fluid from flowing from the pilot primary-side line 41 side toward the pilot line 40 side.

The unloading valve 14 is a solenoid selector valve, which has a spring 14*b* on one end side thereof, and an operation section 14*a* on the other end side thereof. According to the presence or absence of a command signal outputted from the controller 100 to the operation section 14*a*, spool position of the unloading valve 14 is switched over, so as to control communication/interruption in regard of flow of the hydraulic fluid delivered by the pilot hydraulic pump 7 to the tank 6A. In other words, with the unloading valve 14 being actuated to open, the hydraulic fluid delivered by the pilot hydraulic pump is relieved to the tank 6A. Therefore, the unloading valve 14 controls an unloading function of the pilot hydraulic pump 7.

The pilot primary-side line 41 is provided with a branching section 41*a*1, and one end side of a connection line 42 is connected to the branching section 41*a*1. The other end side of the connection line 42 is connected to the accumulator 11 and the recovery line 34.

The connection line 42 is provided with a pressure reducing valve 15 which has a high pressure side disposed on the accumulator 11 side and has a low pressure side disposed on the branching section 41*a*1 side. In addition, a bypass line 43 bypassing between the high pressure side and the low pressure side of the pressure reducing valve 15 is provided, and the bypass line 43 is provided with a third check valve 16 as a pressure increasing device. The third check valve 16, provided between the accumulator 11 and the pilot primary-side line 41, permits hydraulic fluid to only flow from the pilot primary-side line 41 toward the accumulator 11 side, and inhibits the hydraulic fluid from flowing from the accumulator 11 side toward the pilot primary-side line 41 side.

The pressure reducing valve 15 is for reducing the pressure of high-pressure hydraulic fluid accumulated in the accumulator 11, and for supplying the hydraulic fluid at an appropriate pressure to the pilot primary-side line. On the other hand, the third check valve 16 as the pressure increasing device is for supplying the hydraulic fluid delivered by the pilot hydraulic pump 7 to the accumulator 11 through the pilot primary-side line 41 and the connection line 42 and the bypass line 43 when the hydraulic fluid is not accumulated in the accumulator 11 or the pressure therein is low. By this, the pressure in the accumulator 11 can be increased.

A pressure sensor 17 is attached to the pilot primary-side line 41. This pressure sensor 17 detects the pilot pressure Pi in the pilot primary-side line 41 (the pilot pressure between the pilot valve 5 and the second check valve 13), and functions as signal conversion means for converting the detected pressure into an electrical signal corresponding to the detected pressure, and it is configured to be able to output the electrical signal to the controller 100.

To the controller 100, the lowering-side pilot pressure Pd of the pilot valve 5 of the operation device 4 is inputted from the pressure sensor 21, and the pilot primary pressure Pi supplied to the pilot valve 5 of the operation device 4 is inputted from the pressure sensor 17. The controller 100 performs calculations according to the input values, and outputs control commands to the regeneration control valve 9 and the unloading valve 14.

Figure 3:
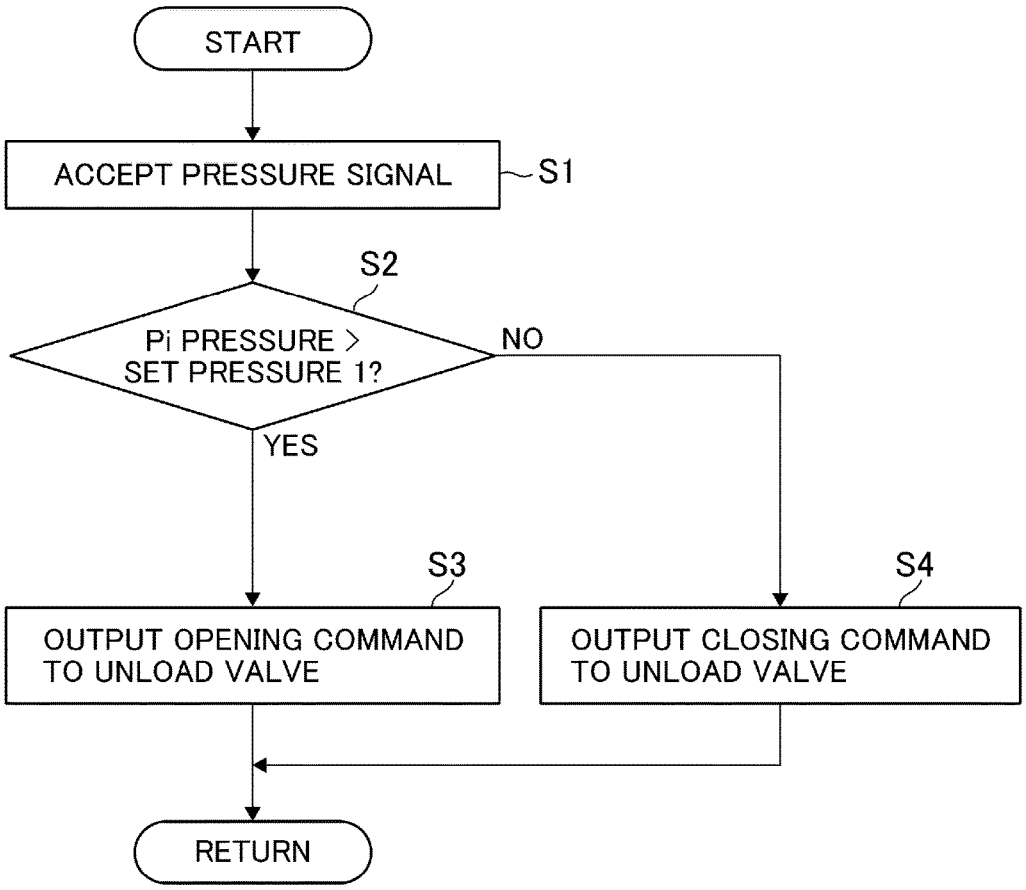
FIG. 3 is a flow chart showing an example of the contents of a process of a controller constituting one embodiment of the construction machine of the present invention.

Now, control of the unloading valve 14 according to the pressure in the accumulator 11 that is executed by the controller 100 in the first embodiment of the construction machine of the present invention described above will be outlined referring to FIG. 3. FIG. 3 is a flow chart showing an example of the contents of a process of the controller constituting one embodiment of the construction machine of the present invention.

First, for example, a state where a key switch (not shown) of the hydraulic excavator 1 is turned ON by the operator is made to be the state at START of control process. The controller 100 is fed with a pressure signal (the pilot pressure Pi in the pilot primary-side line 41) detected by the pressure sensor 17 (step S1).

Next, the controller 100 judges whether or not the pilot pressure Pi in the pilot primary-side line 41 thus detected is higher than a preset pilot set pressure 1 (step S2). In other words, the controller 100 judges whether or not the hydraulic fluid accumulated in the accumulator 11 exceeds a predetermined pressure. In the case where the hydraulic fluid is sufficiently accumulated in the accumulator 11, the hydraulic fluid is supplied to the pilot primary-side line 41 through the pressure reducing valve 15, so that the pilot pressure Pi is higher than the pilot set pressure 1. In the case where the pilot pressure Pi in the pilot primary-side line 41 is higher than the pilot set pressure 1, the control process proceeds to (step S3), and in the other cases the control process proceeds to (step S4).

The controller 100 outputs an opening command to the unloading valve 14 (step S3). Specifically, a command signal for actuating the unloading valve 14 to open is outputted from the controller 100 to the operation section 14*a* of the unloading valve 14. After the processing of the (step S3) is executed, the control process returns to the (step S1) through RETURN, and the process is started again. As a result, when the unloading valve 14 is actuated to open, the hydraulic fluid delivered by the pilot hydraulic pump 7 is discharged to the tank 6A through the unloading valve 14. Consequently, the pilot hydraulic pump 7 is unloaded, so that the output power is suppressed, and a reduction in fuel efficiency can be realized.

In the case where another operation lever which is not shown is further operated and the pilot control system needs hydraulic fluid, the hydraulic fluid is supplied from the accumulator 11, pilot secondary hydraulic fluid is supplied from the pilot valve in conjunction with the operation lever, and the relevant control valve is switched, whereby an actuation of the hydraulic actuator desired by the operator can be performed.

Returning to FIG. 3, in the case where it is judged in the (step S2) that the pilot pressure Pi in the pilot primary-side line 41 is not exceeding (is equal to or lower than) the pilot set pressure 1, the controller 100 outputs a closing command to the unloading valve 14 (step S4). Specifically, this is realized by not outputting an opening command signal from the controller 100 to the operation section 14*a* of the unloading valve 14. This results in that when the unloading valve 14 is actuated to close, the hydraulic fluid delivered by the pilot hydraulic pump 7 is discharged to the tank 6A through the second check valve 13 and the third check valve 16 and the unloading valve 14. After the processing of the (step S4) is executed, the control process returns to the (step S1) through RETURN, and the process is started again.

When the unloading valve 14 is thus actuated to close, the hydraulic fluid delivered by the pilot hydraulic pump 7 is supplied to the accumulator 11 through the second check valve 13, the pilot primary-side line 41, the connection line 42, the bypass line 43, and the third check valve 16. In addition, the hydraulic fluid is supplied also to pilot valves of other operation levers which are not shown.

As a result, the pilot primary hydraulic fluid necessary for the pilot valves of a plurality of operation levers is secured. In addition, pressure accumulation in the accumulator 11 can be performed. Furthermore, since the pilot primary hydraulic fluid is supplied from the pilot hydraulic pump 7 to the pilot valve 5 of the operation device 4 through only the second check valve 13, a delay in response is not generated and response properties of the fluid actuators can be secured even in the case where pressure variations in the pilot system (the primary hydraulic fluid and the secondary hydraulic fluid) are large.

Figure 4:
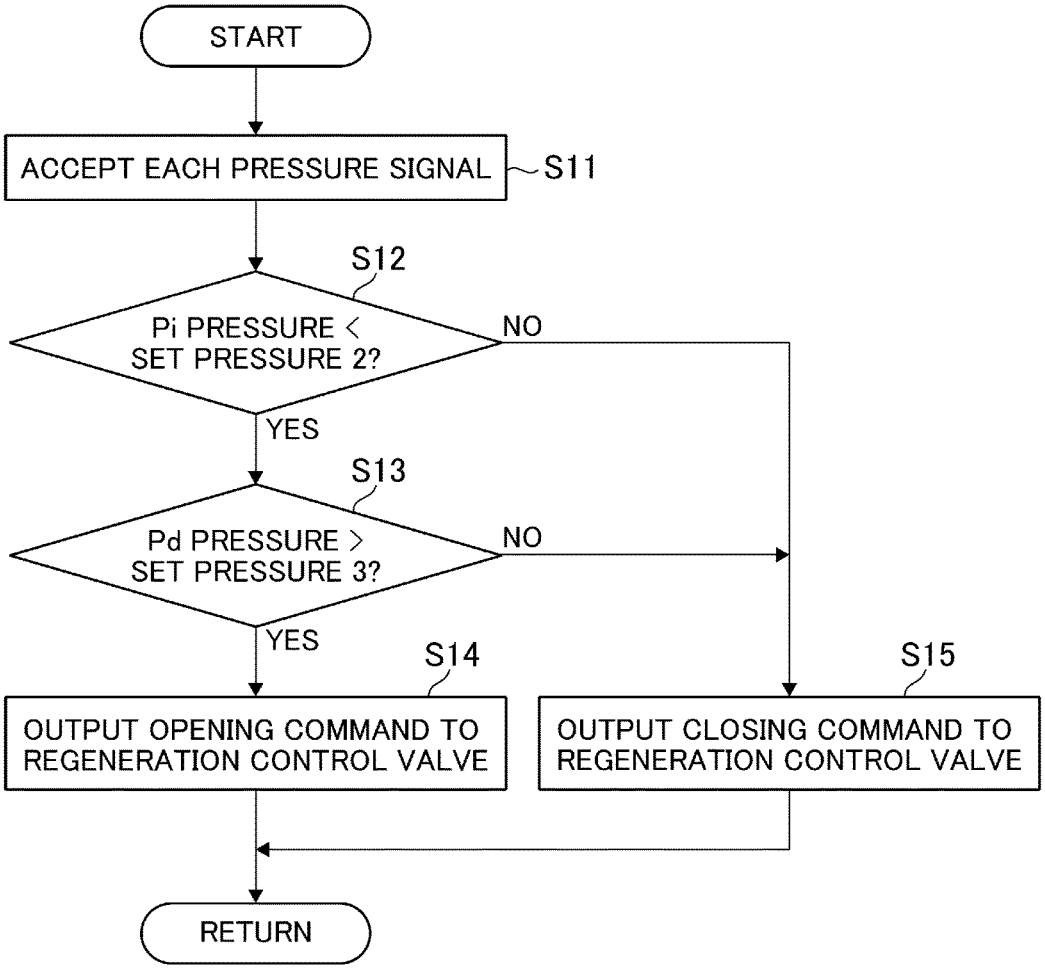
FIG. 4 is a flow chart showing another example of the contents of a process of the controller constituting one embodiment of the construction machine of the present invention.

Now, control of the regeneration control valve 9 according to the pressure in the accumulator 11 and the boom lowering pilot pressure that is executed by the controller 100 in the first embodiment of the construction machine of the present invention described above will be outlined referring to FIG. 4. FIG. 4 is a flow chart showing another example of the contents of a process of the controller constituting one embodiment of the construction machine of the present invention.

First, for example, a state where the key switch (not shown) of the hydraulic excavator 1 is turned ON by the operator is made to be the state of START of control process. Note that in this example, calculations are performed simultaneously with the example shown in FIG. 3, and, for example, this is realized in multi-task processing of the controller 100. The controller 100 is fed with pressure signals (the pilot pressure Pi in the pilot primary-side line 41, the boom lowering pilot pressure Pd) detected by the pressure sensors 17 and 21 (step S11).

Next, the controller 100 judges whether or not the pilot pressure Pi in the pilot primary-side line 41 thus detected is lower than a preset pilot set pressure 2 (step S12). Here, the pilot set pressure 2 is set at an abnormally higher pressure than the usual pilot primary pressure. For example, it is judged whether or not the pressure reducing valve 15 is failed and the high pressure in the accumulator 11 is led as it is into the pilot primary-side line 41. In the case where the pilot pressure Pi in the pilot primary-side line 41 is lower than the pilot set pressure 2, the control process proceeds to (step S13), and in the other cases the control process proceeds to (step S15).

The controller 100 judges whether or not the boom lowering pilot pressure Pd detected is higher than a preset pilot set pressure 3 (step S13). Specifically, the controller 100 judges whether or not the operation amount of the operation device 4 exceeds a predetermined operation amount. In the case where the boom lowering pilot pressure Pd is higher than the pilot set pressure 3 (in the case where the operation amount exceeds the predetermined operation amount), the control process proceeds to (step S14), and in the other cases the control process proceeds to the (step S15).

In the case where it is judged in the (step S13) that the boom lowering pilot pressure Pd is higher than the pilot set pressure 3 (in the case where the operation amount is in excess of a predetermined operation amount), the controller 100 outputs an opening command to the regeneration control valve 9 (step S14). Specifically, when it is judged that the pilot pressure Pi in the pilot primary-side line 41 is not an abnormally high pressure and the operation device 4 has been put to a boom lowering operation exceeding a predetermined amount, a command signal for actuating the regeneration control valve 9 to open is outputted. By this, the regeneration control valve 9 is actuated to open, the return hydraulic fluid from the bottom-side hydraulic chamber 3*ax* of the boom cylinder 3*a* flowing in the recovery line 34 is accumulated into the accumulator 11 through the regeneration control valve 9 and the first check valve 10, and is supplied to a portion (pilot primary-side line 41) between the second check valve 13 and the pilot valve 5 through the pressure reducing valve 15. After the processing of the (step S14) is executed, the control process returns to the (step S1) through RETURN, and the process is started again.

In the case where it is judged in the (step S12) that the pilot pressure Pi in the pilot primary-side line 41 is equal to or higher than the pilot set pressure 2 or in the case where it is judged in the (step S13) that the boom lowering pilot pressure Pd is equal to or lower than the pilot set pressure 3 (in the case where the operation amount is equal to or less than a predetermined operation amount), the controller 100 outputs a closing command to the regeneration control valve 9 (step S15). Specifically, in the case where it is judged that either of the conditions of the (step S12) and the (step S13) is not satisfied, the controller 100 outputs a closing command to the regeneration control valve 9, so as not to actuate the regeneration control valve 9. This is realized by not outputting an opening command signal, in the present embodiment. After the processing of the (step S15) is executed, the control process returns to the (step S1) through RETURN, and the process is started again.

Actuations of each section when the boom operation is conducted in one embodiment of the construction machine of the present invention will be described below.

First, when the operation lever of the operation device 4 shown in FIG. 2 is tilted in a-direction (boom raising direction), the pilot pressure Pu generated from the pilot valve 5 is transmitted to the pilot pressure receiving section 2*a* of the control valve 2, and the control valve 2 is thereby switched over. By this, the hydraulic fluid from the hydraulic pump 6 is led to the bottom-side hydraulic chamber line 32, and flows into the bottom-side hydraulic chamber 3*ax* of the boom cylinder 3*a* through the pilot check valve 8. As a result, the boom cylinder 3*a* is actuated to extend.

Attendant on this, the return hydraulic fluid discharged from the rod-side hydraulic chamber 3*ay* of the boom cylinder 3*a* is led to the tank 6A through the rod-side hydraulic chamber line 31 and the control valve 2. In this instance, the regeneration control valve 9 is in a closed state, and, therefore, the hydraulic fluid does not flow into the accumulator 11.

Next, when the operation lever of the operation device 4 is tilted in b-direction (boom lowering direction), the pilot pressure Pd generated from the pilot valve 5 is detected by the pressure sensor 21 and inputted to the controller 100. Besides, the controller 100 judges the presence or absence of execution of energy recovery in regard of the return hydraulic fluid, based on the pilot pressure Pi in the pilot primary-side line 41 detected by the pressure sensor 17. Specifically, in the case where the detected pilot pressure Pi exceeds the pilot set pressure 2 set to be abnormally higher than the usual pressure, it is considered, for example, that the pressure reducing valve 15 has been failed and the high pressure in the accumulator 11 has flowed as it is into the pilot primary-side line 41; in this case, therefore, the regeneration control valve 9 is closed, so as not to perform energy recovery in regard of the return hydraulic fluid.

In the case where it is judged that energy recovery in regard of the return hydraulic fluid is not to be performed, the pilot pressure Pd generated from the pilot valve 5 is exerted on the pilot pressure receiving section 2*b* of the control valve 2 and on the pilot check valve 8, so that the control valve 2 is switched over, and the pilot check valve 8 is actuated to open. By this, the hydraulic fluid from the hydraulic pump 6 is led to the rod-side hydraulic chamber line 31, and flows into the rod-side hydraulic chamber 3*ay* of the boom cylinder 3*a*. As a result, the boom cylinder 3*a* is actuated to shrink. Attendant on this, the return hydraulic fluid discharged from the bottom-side hydraulic chamber 3*ax* of the boom cylinder 3*a* is led to the tank 6A through the pilot check valve 8, the bottom-side hydraulic chamber line 32, and the control valve 2. In this instance, the regeneration control valve 9 is in a closed state, and, therefore, the hydraulic fluid does not flow into the accumulator 11.

On the other hand, in the case where it is judged that energy recovery in regard of the return hydraulic fluid is to be performed, the controller 100 judges whether or not the operation amount of the operation device 4 is in excess of a predetermined operation amount, by comparing the boom lowering pilot pressure Pd detected by the pressure sensor 17 with the pilot set pressure 3, and outputs an opening command to the regeneration control valve 9 when the operation amount of the operation device 4 is in excess of the predetermined operation amount. The switching operation of the control valve 2, the opening actuation of the pilot check valve 8, and the flowing of the hydraulic fluid from the hydraulic pump 6 into the rod-side hydraulic chamber 3*ay* are the same as those in the case where it is judged that energy recovery in regard of the return hydraulic fluid is not to be performed. Since the internal line of the control valve 2 connected to the bottom-side hydraulic chamber line 32 is throttled, most of the return hydraulic fluid discharged from the bottom-side hydraulic chamber 3*ax* of the boom cylinder 3*a* flows into the accumulator 11 through the recovery line 34, the regeneration control valve 9, and the first check valve 10, and is supplied through the pressure reducing valve 15 and the connection line 42 into the pilot primary-side line 41 between the pilot valve 5 and the second check valve 13.

When the pilot pressure in the pilot primary-side line 41 is established by this, the controller 100 compares the pilot pressure Pi in the pilot primary-side line 41 detected by the pressure sensor 17 with the pilot set pressure 1, and actuates to open the unloading valve 14. By this, the hydraulic fluid delivered by the pilot hydraulic pump 7 is discharged through the unloading valve 14 into the tank 6A. As a result, the pilot hydraulic pump 7 is unloaded, so that the output power is suppressed, and a reduction in fuel efficiency can be realized.

Note that in the case where it is judged that energy recovery in regard of the return hydraulic fluid is to be performed and where the operation amount of the operation device 4 has become equal to or less than a predetermined operation amount, the controller 100 outputs a closing command to the regeneration control valve 9. In other words, when the lever operation amount of the operation device 4 is small or when the lever operation is not made, the return hydraulic fluid discharged from the bottom-side hydraulic chamber 3*ax* of the boom cylinder 3*a* is prevented from flowing into the accumulator 11.

According to the one embodiment of the construction machine of the present invention described above, the output power of the pilot pump 7 can be reduced by the return hydraulic fluid from the hydraulic actuator 3*a*. In addition, even when the pressure in the accumulator 11 is lowered and the hydraulic fluid from the pilot pump 7 is supplied to the pilot system, energy can be utilized effectively and response properties of the hydraulic actuator 3*a* can be secured.

Figure 5:
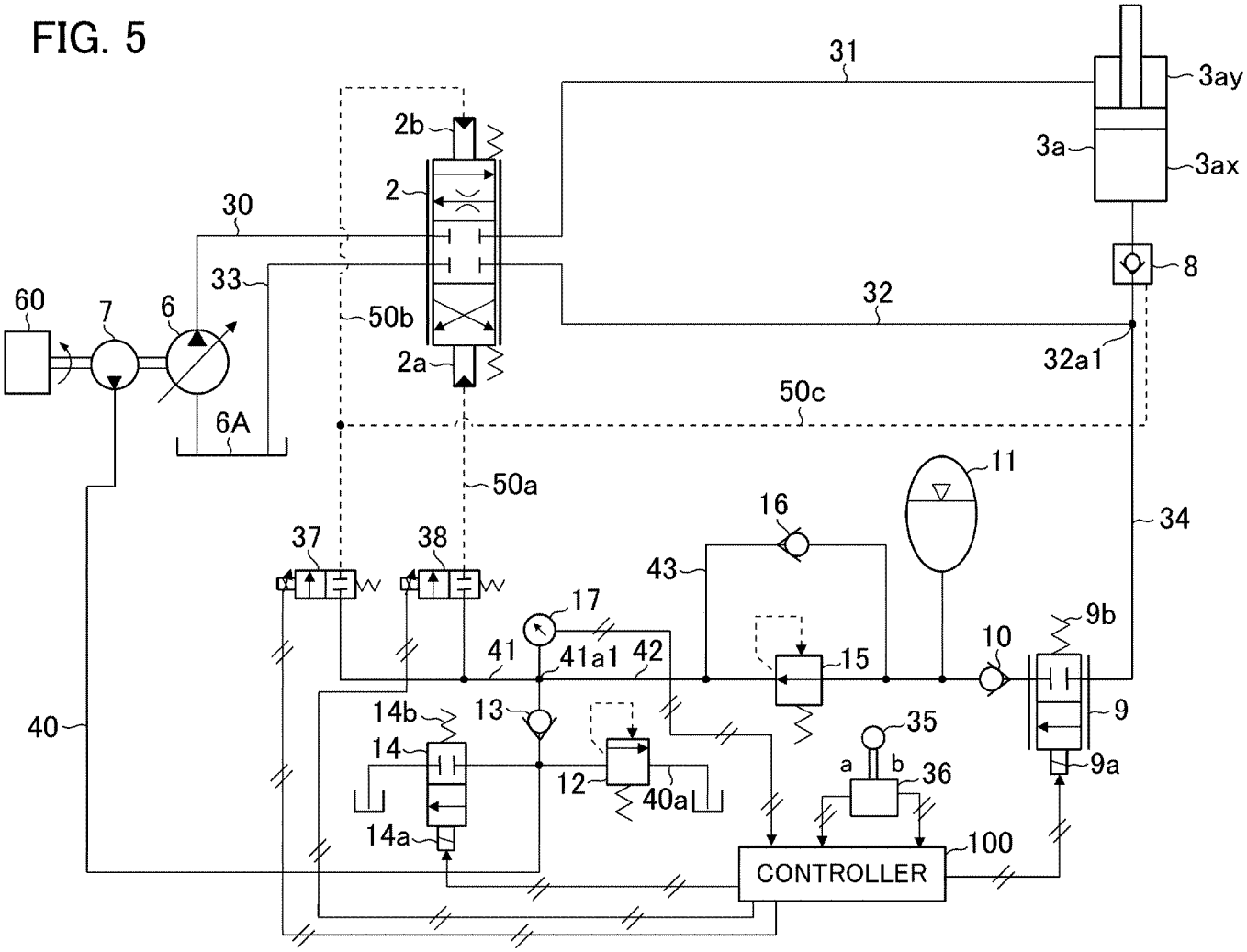
FIG. 5 is a schematic drawing showing another example of a control system constituting one embodiment of the construction machine of the present invention.

Note that description based on an example in which the pilot valve 5 provided in the operation device 4 serves as a control valve drive device has been made in the one embodiment of the construction machine of the present invention, but this configuration is not restrictive. For instance, FIG. 5 is a schematic drawing showing another example of the control system constituting one embodiment of the construction machine of the present invention. As shown in the figure, a control valve drive device may be used in which a control valve 2 is driven by: an electric lever 35; an electric lever sensor 36 that measures an operation amount of the electric lever 35 and outputs the operation amount to a controller 100; and solenoid proportional valves 37 and 38 to which commands are inputted from the controller 100 and from which desired pilot pressures are outputted.

Note that the present invention is not limited to the above-described embodiments, and various modifications are encompassed therein. For instance, the above embodiments have been described in detail for easy understanding of the present invention, and the invention is not limited to those embodiments which necessarily include all the configurations described above.

DESCRIPTION OF REFERENCE SYMBOLS

1: Hydraulic excavator
1*a*: Boom
2: Control valve
2*a*: Pilot pressure receiving section
2*b*: Pilot pressure receiving section
3*a*: Boom cylinder
3*ax*: Bottom-side hydraulic chamber
3*ay*: Rod-side hydraulic chamber
4: Operation device
5: Pilot valve (Control valve drive device)
6: Hydraulic pump
6A: Tank
7: Pilot hydraulic pump
8: Pilot check valve
10: First check valve
11: Accumulator
12: Relief valve
13: Second check valve
14: Unloading valve
15: Pressure reducing valve
16: Third check valve (Pressure increasing device)
17: Pressure sensor
21: Pressure sensor
30: Line
31: Rod-side hydraulic chamber line

32: Bottom-side hydraulic chamber line
33: Return line
34: Recovery line
40: Pilot line
41: Pilot primary-side line
42: Connection line
43: Bypass line
50*a*, 50*b*, 50*c*: Pilot secondary-side line
60: Engine
100: Controller (Controller)

The invention claimed is:

1. A construction machine comprising:

a hydraulic actuator;

a hydraulic pump that supplies hydraulic fluid to the hydraulic actuator;

a control valve that switchingly supplies the hydraulic fluid from the hydraulic pump to the hydraulic actuator;

an operation lever device that switchingly operates the control valve;

a control valve drive device that supplies pilot secondary hydraulic fluid to the control valve in accordance with an operation of the operation lever device;

a pilot hydraulic pump that supplies pilot primary hydraulic fluid to the control valve drive device;

a pressure accumulation device that recovers return hydraulic fluid returned from the hydraulic actuator, a check valve provided in a line between the pilot hydraulic pump and the control valve drive device;

a pressure reducing valve that supplies the hydraulic fluid accumulated in the pressure accumulation device to a line between the check valve and the control valve drive device;

a flow rate reduction device capable of reducing flow rate of the hydraulic fluid delivered by the pilot hydraulic pump;

a pressure detection device capable of detecting pressure in the line between the check valve and the control valve drive device; and a controller that controls the flow rate reduction device in accordance with the pressure detected by the pressure detection device, wherein the flow rate reduction device is an unloading valve provided in a line between the pilot hydraulic pump and a tank, and the unloading valve is controlled by a command signal from the controller.

2. The construction machine according to claim 1, further comprising:

a pressure increasing device that increases the pressure in the pressure accumulation device by leading the hydraulic fluid delivered by the pilot hydraulic pump to the pressure accumulation device.

3. The construction machine according to claim 1, further comprising:

a regeneration control valve that is provided in a line between the hydraulic actuator and the pressure accumulation device and has an opening controlled by the controller, wherein the controller closes the opening of the regeneration control valve when an abnormal high pressure exceeding a preset pressure is detected by the pressure detection device.

* * * * *